US012070055B2

(12) United States Patent
Griffin

(10) Patent No.: US 12,070,055 B2
(45) **Date of Patent: *Aug. 27, 2024**

(54) VALET FOR HAND-ROLLED CIGARETTES

(71) Applicant: Dexter Griffin, Atlanta, GA (US)

(72) Inventor: Dexter Griffin, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/939,892

(22) Filed: Sep. 7, 2022

(65) Prior Publication Data

US 2023/0000138 A1 Jan. 5, 2023

Related U.S. Application Data

(63) Continuation of application No. 16/380,682, filed on Apr. 10, 2019, now Pat. No. 11,439,176.

(51) Int. Cl.

| | |
|---|---|
| ***B65D 85/10*** | (2006.01) |
| ***A24B 7/00*** | (2006.01) |
| ***A24C 5/44*** | (2006.01) |
| ***A24F 15/18*** | (2006.01) |
| ***A24F 17/00*** | (2006.01) |
| ***A24F 23/00*** | (2006.01) |
| ***B65D 1/36*** | (2006.01) |
| ***B65D 6/06*** | (2006.01) |

(52) U.S. Cl.

CPC ..... *A24C 5/44* (2013.01); *A24B 7/00* (2013.01); *A24F 15/18* (2013.01); *A24F 17/00* (2013.01); *A24F 23/00* (2013.01); *B65D 1/36* (2013.01); *B65D 11/12* (2013.01); *B65D 85/10* (2013.01); *B65D 2313/04* (2013.01)

(58) Field of Classification Search

CPC ..... B65D 1/36; B65D 11/12; B65D 85/10; B65D 2313/04; A24B 7/00; A24F 15/18; A24F 17/00; A24F 23/00; A24C 5/08; A24C 5/44

USPC ..... 206/242, 268; 131/58; 220/695, 220/697–701

See application file for complete search history.

(56) References Cited

U.S. PATENT DOCUMENTS

| | | | | |
|---|---|---|---|---|
| 1,326,070 | A | 12/1919 | Lewis | |
| 2,848,153 | A * | 8/1958 | Geiger, Sr. | B65D 5/6623 206/268 |
| 3,446,338 | A * | 5/1969 | Bozyk | B65D 85/1009 206/268 |
| D510,481 | S | 10/2005 | Hodgson | |
| 8,584,842 | B2 | 11/2013 | Fakhouri et al. | |
| D737,509 | S | 8/2015 | Now | |
| 9,402,420 | B2 | 8/2016 | Barrett | |
| D789,599 | S | 6/2017 | Kesselman et al. | |
| 9,938,042 | B1 | 4/2018 | Aryanpanah et al. | |
| 2005/0236282 | A1 | 10/2005 | Huska | |
| 2006/0237026 | A1 | 10/2006 | Simester | |

(Continued)

*Primary Examiner* — Luan K Bui

(74) *Attorney, Agent, or Firm* — Ballard Spahr LLP

(57) ABSTRACT

A cigarette valet including a base portion having a pair of opposed side walls, a pair of opposed end walls extending therebetween, a top wall, and an opposed bottom wall, wherein the base portion defines an interior compartment, one of the side walls includes a first flange defining a first recess, and one of the end walls includes a second flange defining a second recess, and a substantially-triangular receptacle including a first flange and a second flange that are slidably received in the first recess and the second recess, and a drawer that is slidably disposed within the interior compartment of the base portion.

19 Claims, 2 Drawing Sheets

(56) References Cited

U.S. PATENT DOCUMENTS

| | | | |
|---|---|---|---|
| 2007/0284277 | A1 | 12/2007 | Gnepper |
| 2011/0204074 | A1 | 8/2011 | Gelardi et al. |
| 2015/0272202 | A1 | 10/2015 | Clayton |
| 2020/0236988 | A1 | 7/2020 | Jarrett |

* cited by examiner

VALET FOR HAND-ROLLED CIGARETTES

CROSS-REFERENCE TO RELATED APPLICATION

The present application is a Continuation of U.S. patent application Ser. No. 16/380,682 filed Apr. 10, 2019, now U.S. Pat. No. 11,439,176, the disclosure of which is hereby incorporated by reference in its entirety.

TECHNICAL FIELD

The presently-disclosed invention relates generally to tobacco products and, more specifically, to a valet for containing the materials used to produce hand-rolled cigarettes.

BACKGROUND

In recent years, there has been an increase in the popularity of hand-rolling cigarettes. Hand-rolling cigarettes requires a number of materials such as, but not limited to, wrapping papers, tobacco, a tobacco shredder, etc., and can be fairly messy. As such, there exists a need to keep the materials in a centralized location that also allows for simplified cleaning of the area in which cigarettes are rolled.

SUMMARY OF INVENTION

One embodiment of the present invention provides a cigarette valet including a base portion having a pair of opposed side walls, a pair of opposed end walls extending therebetween, a top wall, and an opposed bottom wall, wherein the base portion defines an interior compartment, one of the side walls includes a first flange defining a first recess between the first flange and the top wall, and one of the end walls includes a second flange defining a second recess between the second flange and the top wall, a substantially-triangular receptacle including a first flange and a second flange, the first flange and the second flange of the receptacle being slidably received in the first recess and the second recess, respectively, of the base portion so that the receptacle is selectably attachable to the base portion, and a drawer including at least one bin, the drawer being slidably disposed within the interior compartment of the base portion.

Another embodiment of the present invention provides a cigarette valet including a base portion having a pair of opposed side walls, a pair of opposed end walls extending therebetween, a top wall, an opposed bottom wall, and an upwardly-extending lip disposed along an outer perimeter of the top wall of the base portion, wherein the base portion defines an interior compartment, a scraper tool including a substantially-rectangular blade portion and a gripper portion extending along an edge thereof, and a drawer including at least one bin, the drawer being slidably disposed within the interior compartment of the base portion, wherein the top wall of the base portion defines a slot disposed adjacent the outer perimeter thereof, and the scraper tool is slidably received in the slot so that the gripper portion of the scraper tool is contiguous with the lip of the base portion.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

The invention now will be described more fully hereinafter with reference to the accompanying drawings, in which some, but not, all embodiments of the invention are shown. Indeed, this invention may be embodied in many different forms and should not be construed as limited to the embodiments set forth herein; rather, these embodiments are provided so that this disclosure will satisfy applicable legal requirements.

Figure 1:
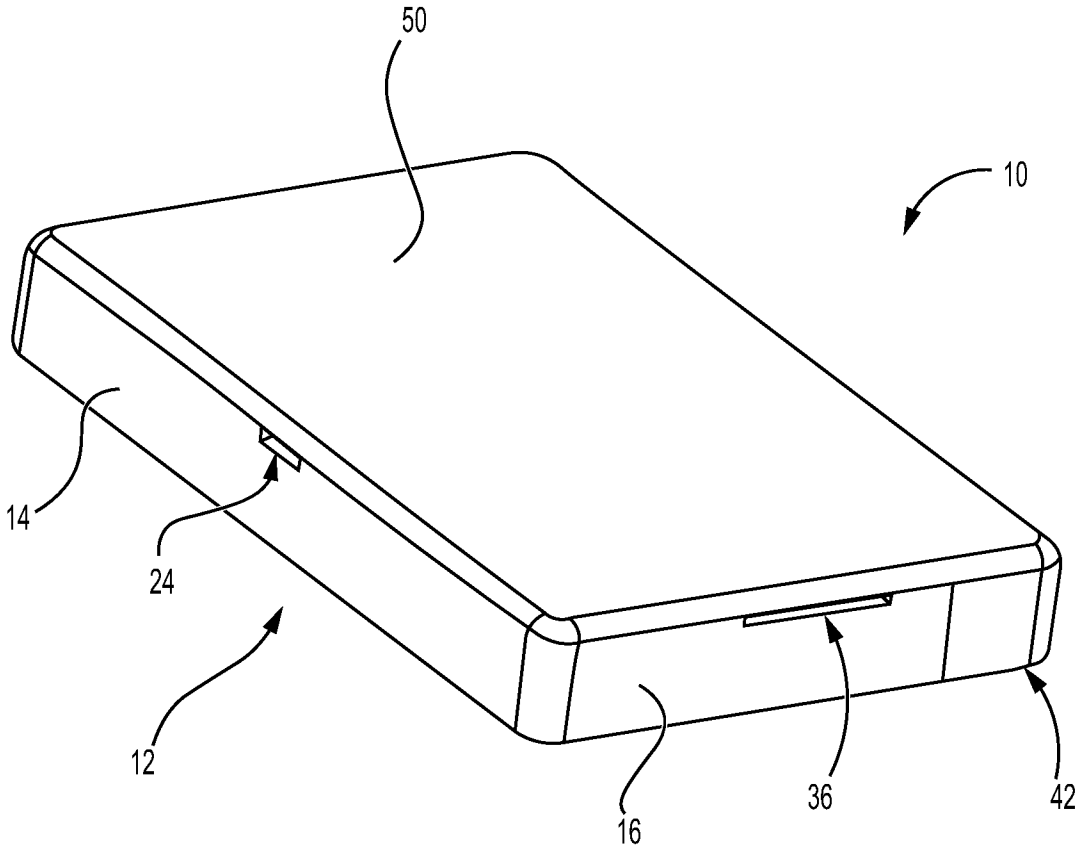
FIG. 1 is a perspective view of a valet for containing materials for hand-rolling cigarettes, in accordance with an embodiment of the present invention.

Repeat use of reference characters in the present specification and drawings is intended to represent same or analogous features or elements of the invention according to the disclosure.

DETAILED DESCRIPTION

The invention now will be described more fully hereinafter with reference to the accompanying drawings, in which some, but not, all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

Figure 2:
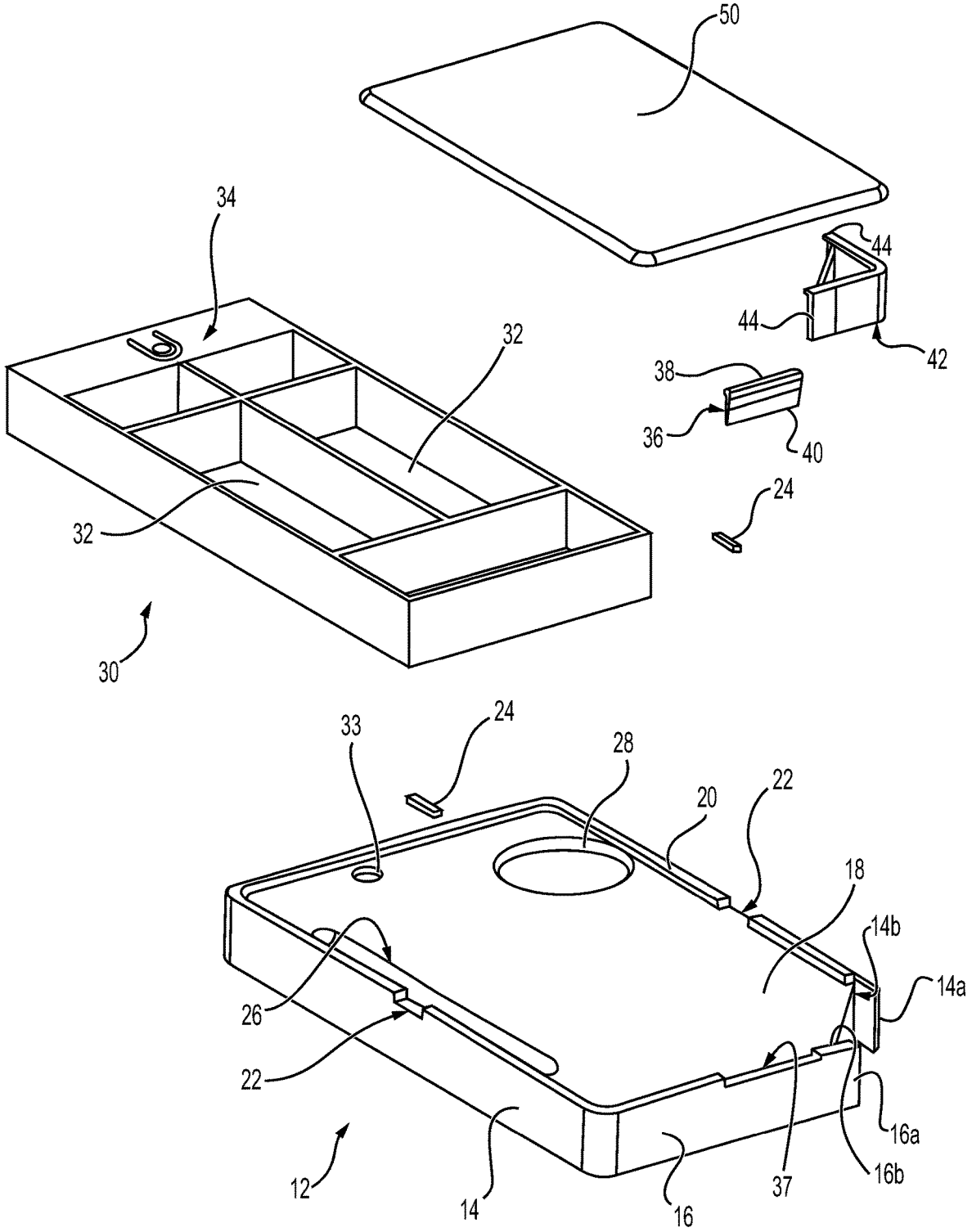
FIG. 2 is an exploded perspective view of the valet for hand-rolling cigarettes shown in FIG. 1.

Referring now to FIGS. 1 and 2, a cigarette valet 10 that facilitates both storing the required materials for hand-rolling cigarettes and rolling the cigarettes in a centralized location is shown. The cigarette valet 10 includes a base portion 12, a drawer 30 for storing the required materials, a scraper tool 36, a receptacle 42, and a lid 50 that is removably attached to the base portion 12. As shown, the cigarette valet 10 is substantially-rectangular in shape and is preferably produced by way of injection molding plastics. The base portion 12 includes a pair of side walls 14, a pair of opposed end walls 16 extending therebetween, a bottom wall (not shown), and a top wall 18 that functions as a cigarette preparation surface. As best seen in FIG. 2, one side wall 14 of the base portion 12 includes a flange **14*a* that defines a recess 14*b* between the flange 14*a* and the base portion 12. Similarly, the adjacent end wall 16 includes a flange 16*a* that defines a recess 16*b* between the flange 16*a* and base portion 12. Recesses 14*b* and 16*b* are each configured to slidably receive a corresponding flange 44 of receptacle 42. As shown, the receptacle 42 is substantially triangularly-shaped so that when the receptacle 42 is removably secured to the base portion 12 it forms one of the corners thereof. The position of the receptacle on the base portion 12 allows the scraper tool 36 to be used to scrape any remaining tobacco into the receptacle 42, which may then be detached from the base portion 12 so that the loose tobacco may be returned to the drawer 30** for later use.

Still referring to FIG. 2, the cigarette valet 10 includes the scraper tool 36 that has a substantially rectangular blade portion 40 and a grip portion 38 extending along an edge thereof. The scraper tool 36 is slidably received in a slot 37 that is defined in the end wall 16 of the base portion 12 adjacent the outer perimeter of the base portion's top wall 18. When the blade portion 40 is slidably disposed in the slot 37, the gripper portion 38 of the scraper tool 36 forms a portion of an upwardly extending lip 20 that is disposed along the outer perimeter of the top wall 18. The lip 20 that surrounds the top wall 18 helps to maintain the loose tobacco on the base portion 12 when preparing cigarettes. The lip 20 also defines a pair of recesses 22, each recess 22 being configured to receive a corresponding magnet 24 therein. Similarly, the lid 50 of the cigarette valet 10 includes a correspondingly positioned pair of magnets (not shown) that are arranged to have the opposite polarity of the magnets 24 of the base portion 12. As such, when not in use, the lid 50 is held in place by the magnets to enclose the cigarette valet 10.

The drawer 30 is slidably received in an interior compartment (not shown) that is defined within the base portion 12. The drawer 30 includes one or more bins 32 that are configured to store the materials required to roll cigarettes, such as, but not limited to, loose tobacco, rolling papers, filters, etc. The drawer 30 also includes a detent 34 that is disposed on an upper surface of the drawer 30 and is configured to be received in a first aperture 33 that is defined in the top wall 18 of the base portion 12. The detent 34 helps ensure the drawer 30 is securely held within the base portion 12 until the detent 34 is depressed by a user. As shown in FIG. 2, the top wall 18 also defines a second aperture 28 that is configured to receive a tobacco grinder (not shown), such as those that are commonly known in the art, and an elongated groove 26 that is configured to receive one or more rolled cigarettes therein as others are prepared on the top wall 18. As shown in FIG. 1, when the scraper tool 36 and the receptacle 42 are secured to the base portion 12, the lid 50 totally encloses the cigarette preparation area when it is positioned on the base portion 12 of the cigarette valet 10.

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

The invention claimed is:

1. A cigarette valet comprising:

a base portion including a pair of opposed side walls, a pair of opposed end walls extending therebetween, a top wall, and an opposed bottom wall, wherein the base portion defines an interior compartment, one of the side walls includes a first flange defining a first recess between the first flange and the top wall, and one of the end walls includes a second flange defining a second recess between the second flange and the top wall; and a substantially-triangular receptacle including a first flange and a second flange, the first flange and the second flange of the receptacle being slidably received in the first recess and the second recess, respectively, of the base portion so that the receptacle is selectably attachable to the base portion, wherein the base portion further comprises an upwardly-extending lip disposed along an outer perimeter of the top wall of the base portion.

2. The cigarette valet of claim 1, further comprising a scraper tool including a substantially-rectangular blade portion and a gripper portion extending along an edge thereof.

3. The cigarette of claim 2, wherein the top wall of the base portion defines a slot disposed adjacent the outer perimeter thereof, and the scraper tool is slidably received in the slot so that the gripper portion of the scraper tool is contiguous with the lip of the base portion.

4. The cigarette valet of claim 1, wherein the top wall of the base portion defines an aperture that is configured to receive a tobacco grinder therein.

5. The cigarette valet of claim 1, further comprising:

a drawer including at least one bin, the drawer being slidably disposed within the interior compartment of the base portion.

6. The cigarette valet of claim 5, wherein the top wall of the base portion defines an aperture and the drawer includes a detent, and a portion of the detent is selectively receivable within the aperture.

7. The cigarette valet of claim 1, further comprising a top cover that is selectively secured to the base portion by at least one magnet disposed in the base portion and at least one magnet disposed iv the top cover.

8. The cigarette valet of claim 1, wherein the top wall of the base portion includes a linear, semi-cylindrical groove formed therein.

9. A cigarette valet comprising:

a base portion including a pair of opposed side walls, a pair of opposed end walls extending therebetween, a top wall, and an opposed bottom wall, wherein the base portion defines an interior compartment, one of the side walls includes a first flange defining a first recess between the first flange and the top wall, and one of the end walls includes a second flange defining a second recess between the second flange and the top wall; and a substantially-triangular receptacle including a first flange and a second flange, the first flange and the second flange of the receptacle being slidably received in the first recess and the second recess, respectively, of the base portion so that the receptacle is selectably attachable to the base portion, wherein the top wall of the base portion defines an aperture that is configured to receive a tobacco grinder therein.

10. The cigarette valet of claim 9, herein the base portion further comprises an upwardly-extending lip disposed along an outer perimeter of the top wall of the base portion.

11. The cigarette valet of claim 10, further comprising a scraper tool including a substantially-rectangular blade portion and a gripper portion extending along an edge thereof.

12. The cigarette of claim 11, wherein the top wall of the base portion defines a slot disposed adjacent the outer perimeter thereof, and the scraper tool is slidably received in the slot so that the gripper portion of the scraper tool is contiguous with the lip of the base portion.

13. The cigarette valet of claim 9, further comprising:

a drawer including at least one bin, the drawer being slidably disposed within the interior compartment of the base portion.

14. The cigarette valet of claim 13, wherein the top wall of the base portion defines an aperture and the drawer includes a detent, and a portion of the detent is selectively receivable within the aperture.

15. The cigarette valet of claim 9, further comprising a top cover that is selectively secured to the base portion by at least one magnet disposed in the base portion and at least one magnet disposal in the top cover.

16. The cigarette valet of claim 9, wherein the top wall of the base portion includes a linear, semi-cylindrical groove formed therein.

17. A cigarette valet comprising:

a base portion including a pair of opposed side walls, a pair of opposed end walls extending therebetween, a top wall, and an opposed bottom wall, wherein the base portion defines an interior compartment, one of the side walls includes a first flange defining a first recess between the first flange and the top wall, and one of the end walls includes second flange defining a second recess between the second flange and the top wall, a substantially-triangular receptacle including a first flange and a second flange, the first flange and the second flange of the receptacle being slidably received in the first recess and the second recess, respectively, of the base portion so that the receptacle is selectably attachable to the base portion, and a top cover that is selectively secured to the base portion by at least one magnet disposed in the base portion and at least one magnet disposed in the top cover.

18. The cigarette valet of claim 17, wherein the top wall of the base portion defines an aperture that is configured to receive a tobacco grinder therein.

19. The cigarette valet of claim 17, further comprising:

a drawer including at least one bin, the drawer being slidably disposed within the interior compartment of the base portion.

* * * * *